United States Patent [19]

Wilbur

[11] Patent Number: 4,773,354

[45] Date of Patent: Sep. 27, 1988

[54] APPARATUS FOR UNIFORMLY DISPENSING A PASTE MATERIAL

[75] Inventor: Leonard P. Wilbur, Lancaster, Pa.

[73] Assignee: RCA Licensing Corporation, Princeton, N.J.

[21] Appl. No.: 72,936

[22] Filed: Jul. 13, 1987

[51] Int. Cl.[4] ..... B05C 11/10

[52] U.S. Cl. ..... 118/665; 118/409; 118/410; 118/321; 198/676; 198/550.1; 156/356; 156/578; 222/413; 76/102

[58] Field of Search ..... 118/321, 320, 409, 665, 118/410, 202; 76/102; 198/676, 550.1; 222/413; 156/356, 578

[56] References Cited

U.S. PATENT DOCUMENTS

| | | | |
|---|---|---|---|
| 1,474,050 | 11/1923 | McCurdy | 76/102 |
| 2,896,253 | 7/1959 | Mol | 198/676 X |
| 3,368,724 | 2/1968 | Peters et al. | 222/413 |
| 3,403,658 | 10/1968 | Damm et al. | 118/409 X |
| 3,492,146 | 1/1970 | Kornaker | 118/409 X |
| 3,575,131 | 4/1971 | Lohmann | 118/321 X |
| 4,048,951 | 9/1977 | Tamura | 118/321 X |
| 4,194,463 | 3/1980 | Kimbrough et al. | 118/409 |
| 4,280,864 | 7/1981 | Bromberg | 118/410 X |
| 4,389,969 | 6/1983 | Johnson | 118/665 |
| 4,458,628 | 7/1984 | Fujii et al. | 118/321 X |
| 4,498,415 | 2/1985 | Tsuchiya et al. | 118/409 X |
| 4,576,113 | 3/1986 | Kambara et al. | 118/411 X |
| 4,592,303 | 6/1986 | Wilbur | 118/409 |
| 4,604,967 | 8/1986 | Wilbur, Jr. et al. | 118/668 |

FOREIGN PATENT DOCUMENTS

| | | | |
|---|---|---|---|
| 0619903 | 8/1978 | U.S.S.R. | 118/665 |

*Primary Examiner*—Shrive Beck
*Assistant Examiner*—Alain Bashore
*Attorney, Agent, or Firm*—E. M. Whitacre; D. H. Irlbeck; L. L. Hallacher

[57] ABSTRACT

An apparatus for dispensing high viscosity paste materials onto a seal edge includes a conditioning chamber which permits the build up of a back pressure to aid the exit of the paste from the outlet orifice of the chamber. An auger which dispenses the paste from a hopper to the seal edge has a unique thread pitch to also aid in the dispensing of high viscosity paste to the seal edge.

6 Claims, 1 Drawing Sheet

APPARATUS FOR UNIFORMLY DISPENSING A PASTE MATERIAL

BACKGROUND

This invention relates generally to paste material dispensing apparatus and particularly to an apparatus for uniformly dispensing high viscosity frit material onto a seal edge of a funnel portion of a cathode ray tube (CRT).

A CRT is composed of a faceplate, or panel, and a funnel portion. A phosphor screen is provided on the inside surface of the faceplate and luminescences when impacted by electrons to produce a visual output. The funnel portion includes a neck to support an electron gun which provides the electrons to scan the phosphor screen. The funnel portion and faceplate panel must be permanently and hermetically joined to permit evacuation of the envelope, as required for operation of the CRT. The panel and funnel are each provided with mating seal edges along which they are joined. A vitrifiable material is placed continually along one of the seal edges. The funnel is placed in a carrier and the panel is placed on the funnel with the mating edges aligned. The carrier supports the funnel and panel as they pass through an oven which is raised to high temperature to vitrify the frit material to permanently and hermetically join the two components.

Typically, the frit material is applied to the sealing edge of the funnel by rotating the funnel at a constant rotating speed. A frit material dispenser, including a hopper and a feed auger, is pivotably arranged above the seal edge. The dispenser includes a follower to retain the dispenser above the seal edge as the funnel rotates beneath the dispenser.

U.S. Pat. No. 4,592,303 describes a paste material dispensing device which operates in the manner described above. The device described in this patent operates quite satisfactorily for many purposes. However, problems sometimes arise because the paste material is dispensed onto the seal edge of the funnel as a bead extending completely around the seal edge. Optimum sealing of the panel to the funnel requires the frit material to be uniformly dispensed so that the beginning and end of the bead meet perfectly with neither a gap between, nor an overlap of the bead ends. The frit paste material comes in two forms. In one form, the frit material is a powder substance which must be mixed into a paste prior to being dispensed onto the seal edge. The uniform on-site mixing of various batches of the frit material is extremely difficult because of environmental changes in temperature and humidity. For this reason, premixed frit material is preferable because the material can be uniformly mixed in a controlled atmosphere. Premixed material also avoids the problems of contamination and inconvenience of on-site mixed materials. However, with existing dispensing devices, the use of the premixed frit material is extremely difficult because the viscosity of the premixed material is substantially higher than that of the on-site mixed material. The substantial increase in the viscosity of the premixed material makes it extremely difficult, if not impossible, to uniformly dispense the premixed material as a uniform bead onto the seal edge. For these reasons there is a need for an apparatus for uniformly dispensing high viscosity premixed frit material onto the seal edge of a CRT funnel such that the paste material forms a complete gapless and overlap free bead around the seal edge. The present invention fulfills these needs.

SUMMARY

An apparatus for dispensing paste material from a hopper onto a looped edge of an object rotating beneath the hopper, as an auger pushes the paste material from the hopper onto the edge. The apparatus includes a blade for shearing the paste material upon the completion of a loop around the looped edge. The apparatus also includes a means for sensing the paste material on the looped edge whereby the paste material forms a complete gapless and overlap free bead around the looped edge. A conditioning chamber is interposed the auger and the looped edge whereby high viscous paste material forms a backpressure in the conditioning chamber and is dispensable onto the loop edge.

DETAILED DESCRIPTION

Figure 1:
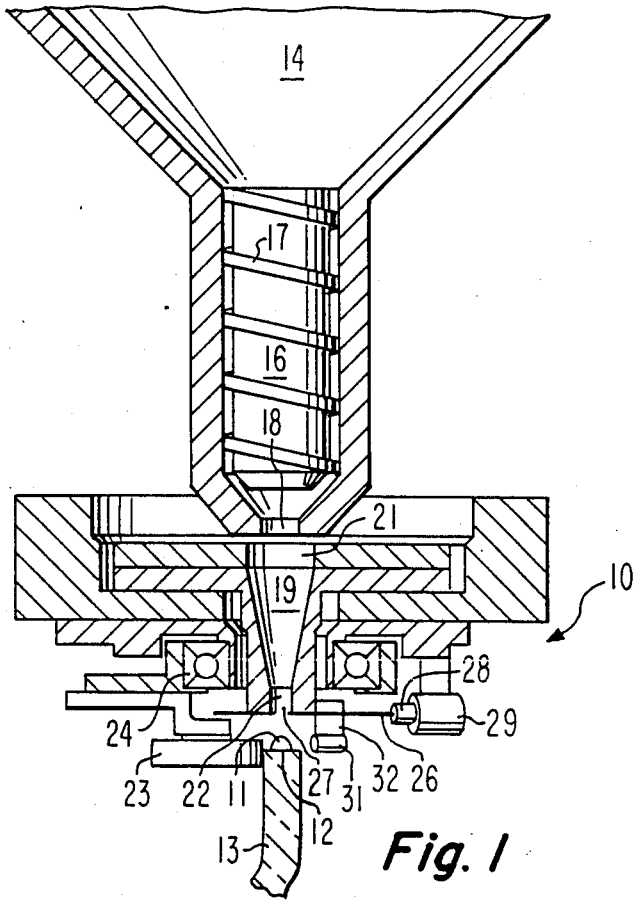
FIG. 1 is a cross section of a preferred embodiment.

In FIG. 1, an apparatus 10 for dispensing a bead 11 of paste material onto the seal edge 12 of a funnel portion 13 of a CRT includes a hopper 14. An auger 16, having a spiral thread 17, is included in the hopper 14 and is used to dispense paste material from the hopper 14 to the seal edge 12 through an outlet 18. The apparatus 10 includes a conical conditioning chamber 19 which is interposed the outlet 18 of the hopper 14 and the seal edge 12. The conditioning chamber 19 includes a wide inlet 21 in the immediate proximity of the outlet 18. The conditioning chamber 19 also includes an outlet orifice 22 in the proximity of the seal edge 12. The conditioning chamber 19 is restricted toward the outlet orifice 22 and therefore the wider inlet 21 permits the chamber 19 to receive material faster than material is dispensed from the chamber. Accordingly, the existence of the chamber 19 permits a back pressure to build up within the chamber and thereby assists in the dispensing of high viscosity materials onto the seal edge 12.

The apparatus 10 includes a rotatable follower 23 which rests against the inside surface of the funnel 13 thereby permitting the apparatus 10 to follow the funnel 13 as the funnel rotates beneath the outlet orifice 22. The follower 23 is mounted on the apparatus 10 by a bearing 24 so that the follower 23 is rotatable with respect to the apparatus 10 thereby maintaining the outlet orifice 22 immediately above the seal edge 12. A blade 26, having an aperture 27 which is aligned with the outlet orifice 22, is affixed to the shaft 28 of a cylinder 29. The funnel 13 is a closed substantially rectangular item and therefore the seal edge 12 is a closed looped edge extending completely around the funnel 13. When the bead 11 has formed a complete loop of frit material completely around the entire seal edge loop, the cylinder 29 is actuated to move the blade 26 and shear the bead of frit material and allow the free end of the sheared bead to fall onto the seal edge 12.

A sensor 31 is affixed to the apparatus 10 by an appropriate mounting bracket 32. The sensor 31 can be a light sensor, or an acoustical sensor, both of which are well known in the art, and is used to sense the beginning of the bead 11 as the bead approaches completion around the looped seal edge 12. The signal from the sensor 31 is used to cause the actuation of the cylinder 29 to shear the bead from the frit material exiting the orifice 22 and a complete gapless and overlap free bead of material is applied to the seal edge 12.

Figure 2:
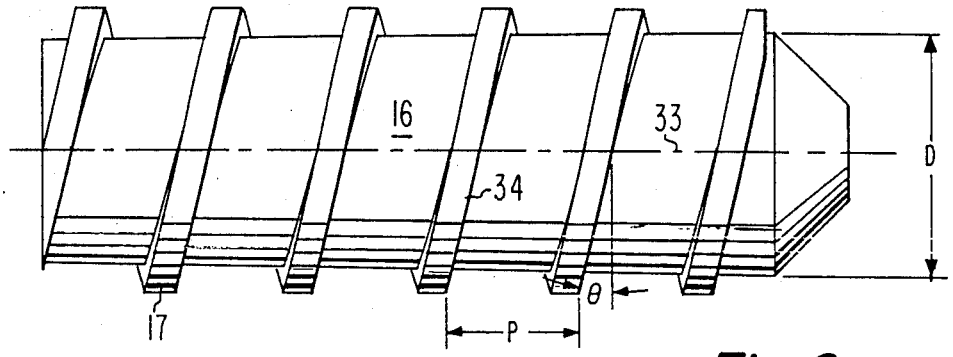
FIG. 2 is a preferred embodiment of a novel auger for dispensing high viscosity paste materials.

In FIG. 2, the auger 16 has a root diameter D. The spiral thread 17 has a pitch P which is equal to at least 50% of the root diameter D of the auger 16. Additionally, the spiral thread 17 is arranged at an angle $\theta$ with respect to the normal to the longitudinal axis 33 of the auger 16. The angle $\theta$ is at least 12°. Accordingly, because of the coarse pitch P of the spiral thread 17 the sides 34 of the thread which act against the paste material being dispensed are substantially increased, as compared to the lengths of the sides of the prior art augers which have substantially finer threads, so that the auger 16 is able to dispense a high viscosity material onto the seal edge 12 of the funnel 13. Accordingly, the novel pitch P of the auger 16 is also effective in allowing the apparatus 10 to dispense high viscosity materials uniformly around the loop seal edge 11.

What is claimed is:

1. In an apparatus for dispensing paste material through an outlet of a hopper onto a looped edge of an object rotating beneath said hopper as an auger pushes said paste material from said hopper onto said edge, a blade for shearing said paste material upon the completion of a loop around said looped edge, improvements comprising:

means for sensing the beginning of said paste material on said looped edge and for actuating said blade to shear said paste material for forming a complete gapless and overlap free bead of said paste material around said looped edge; and a conditioning chamber interposed between said outlet and said looped edge for forming a backpressure in said conditioning chamber and for dispensing a high viscous paste material onto said looped edge.

2. The improvements of claim 1 wherein said conditioning chamber is conical having a wide opening in the proximity of said outlet and an outlet orifice in the proximity of said looped edge.

3. The improvements of claim 2 wherein said auger has a thread pitch equal to at least fifty percent of the root diameter of said auger.

4. The improvement of claim 2 wherein said auger has a thread spiral disposed at an angle of at least 12° with respect to the normal to the longitudinal axis of said auger.

5. The improvements of claim 1 wherein said auger has a thread pitch equal to at least fifty percent of the root diameter of said auger.

6. The improvement of claim 1 wherein said auger has a thread spiral disposed at an angle of at least 12° with respect to the longitudinal axis of said auger.

* * * * *